US008453889B2

(12) United States Patent
Park

(10) Patent No.: US 8,453,889 B2
(45) Date of Patent: Jun. 4, 2013

(54) SPOUT CAP HAVING TWO STEPS TYPE STRAW PART

(75) Inventor: Bong-June Park, Seoul (KR)

(73) Assignee: Dae Ryuk Can Co., Ltd., Seoul (KR)

( * ) Notice: Subject to any disclaimer, the term of this patent is extended or adjusted under 35 U.S.C. 154(b) by 249 days.

(21) Appl. No.: 12/808,669

(22) PCT Filed: Jun. 5, 2008

(86) PCT No.: PCT/KR2008/003164

§ 371 (c)(1),
(2), (4) Date: Jun. 16, 2010

(87) PCT Pub. No.: WO2009/096635

PCT Pub. Date: Aug. 6, 2009

(65) Prior Publication Data

US 2011/0114679 A1 May 19, 2011

(30) Foreign Application Priority Data

Jan. 31, 2008 (KR) ..... 20-2008-0001486 U
Apr. 15, 2008 (KR) ..... 10-2008-0034704

(51) Int. Cl.
*B67D 3/00* (2006.01)

(52) U.S. Cl.
USPC ..... 222/529; 222/528; 222/530; 222/562; 222/541.9

(58) Field of Classification Search
USPC ..... 222/541.9, 526–530, 153.06, 153.07, 222/562, 566, 569–570
See application file for complete search history.

(56) References Cited

U.S. PATENT DOCUMENTS 3,204,827 A * 9/1965 Krautkramer ..... 222/143
3,986,646 A * 10/1976 Strub ..... 222/529

(Continued)

FOREIGN PATENT DOCUMENTS

| | | |
|---|---|---|
| JP | 50-103957 U | 8/1975 |
| JP | 62-137225 U | 8/1987 |
| JP | 63-069709 U | 5/1988 |
| KR | 1999-0027719 | 7/1999 |

OTHER PUBLICATIONS

PCT International Search Report for PCT Counterpart Application No. PCT/KR2008/003164 containing Communication relating to the Results of the Partial International Search Report, 2 pgs., (Sep. 30, 2008).

(Continued)

*Primary Examiner* — Frederick C. Nicolas
(74) *Attorney, Agent, or Firm* — Blakely, Sokoloff, Taylor & Zafman LLP

(57) ABSTRACT

A spout cap having a two steps type straw part comprises a coupling part fixedly coupling with the pouring hole of the metal container; a first straw part extending at a predetermined length on the interior face of the coupling part; a cap coupling part having a pouring outlet through which contents in the metal container flow out, wherein the cap coupling part is selectively positioned in an overlapped disposition or an unfolded disposition with respect to the first straw part; an extension part between the first straw part and the cap coupling part, wherein the extension part is capable of extending the unfolded length when the cap coupling part is unfolded with respect to the first straw part; a second straw part extended from the upper inner face of the extension member at a predetermined length and coupled with the lower end of the cap coupling part.

4 Claims, 4 Drawing Sheets

U.S. PATENT DOCUMENTS

| | | | | | |
|---|---|---|---|---|---|
| 4,219,137 | A | * | 8/1980 | Hutchens | 222/462 |
| 4,555,048 | A | * | 11/1985 | Hamman et al. | 222/478 |
| 4,560,081 | A | * | 12/1985 | Adams | 222/529 |
| 4,618,078 | A | * | 10/1986 | Hamman et al. | 222/478 |
| 4,632,282 | A | * | 12/1986 | Nagashima | 222/529 |
| 4,817,832 | A | * | 4/1989 | Nagy | 222/530 |
| 5,577,643 | A | * | 11/1996 | Stolz | 222/529 |
| 5,601,215 | A | | 2/1997 | Stolz | |
| 5,967,376 | A | * | 10/1999 | McLelland et al. | 222/153.06 |
| 7,789,277 | B2 | * | 9/2010 | Baughman et al. | 222/529 |

OTHER PUBLICATIONS

PCT Notification of Transmittal of International Preliminary Examination Report for PCT Application No. PCT/KR2008/003164, 5 pgs. (Aug. 3, 2008).

Written Opinion of the International Search Authority for PCT Counterpart Application No. PCT/KR2008/003164, 4 pgs. (Sep. 30, 2008).

First Office Action for Chinese Patent Application No. 200880117721.3 and English translation, 9 pgs., (Apr. 6, 2011).

* cited by examiner

[Fig. 1]
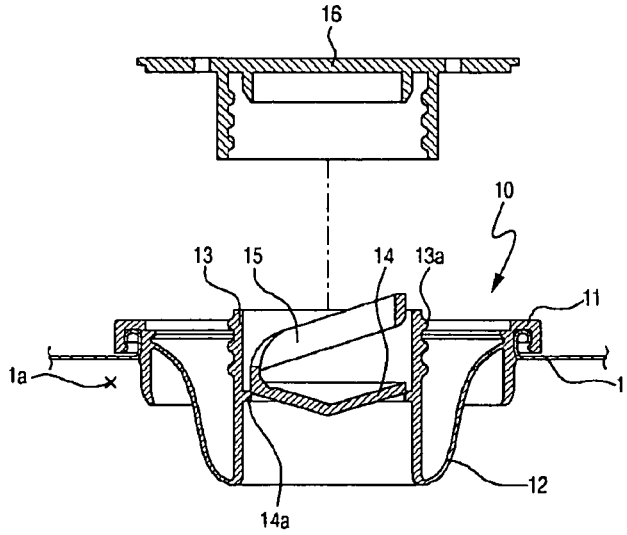
[Fig. 2]
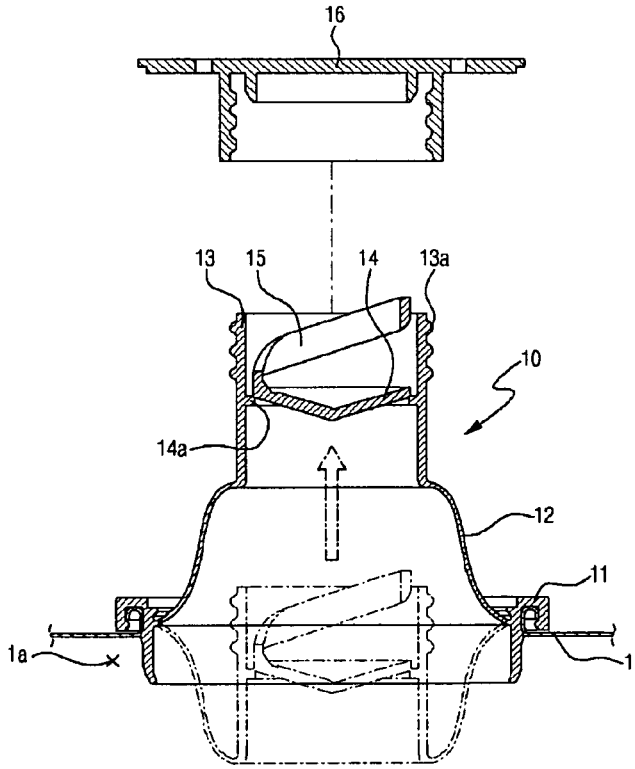

[Fig. 3]
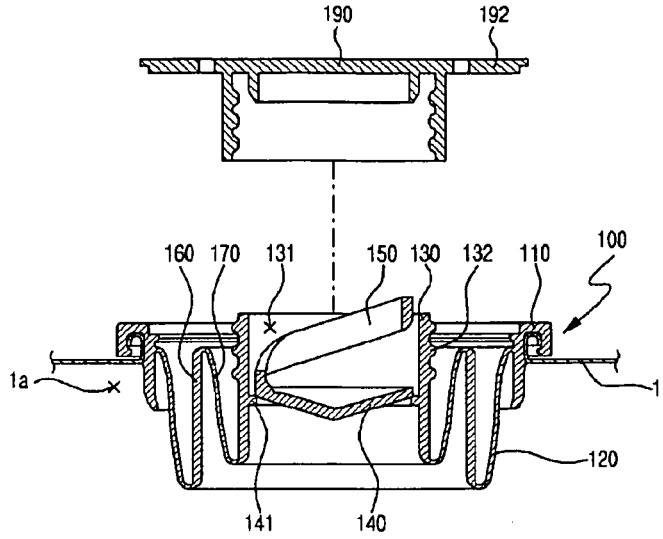
[Fig. 4]
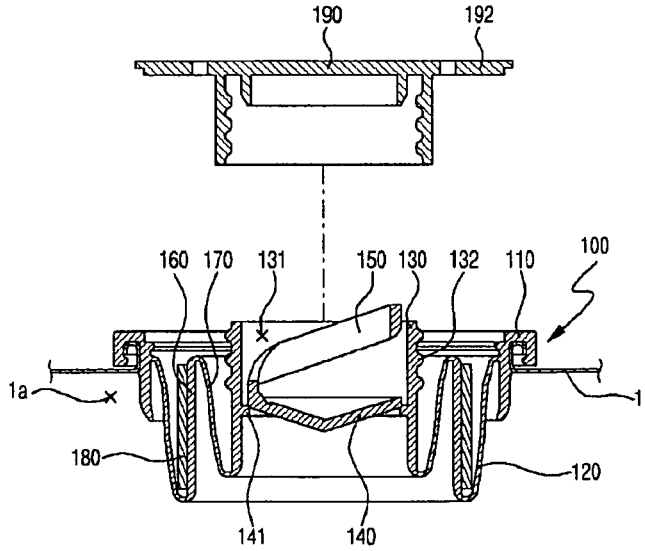

[Fig. 5]
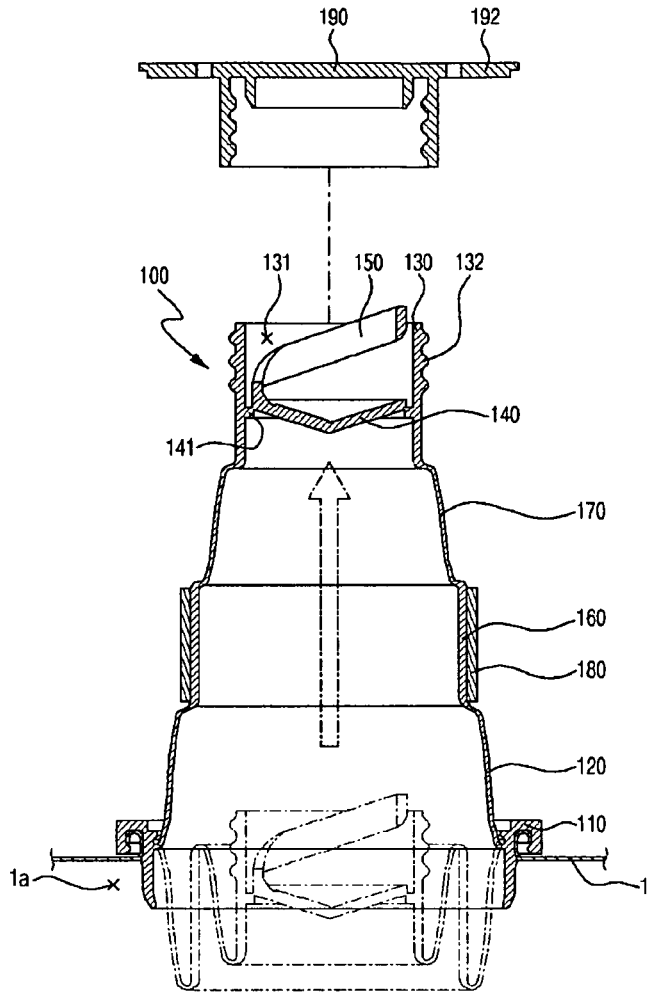
[Fig. 6]
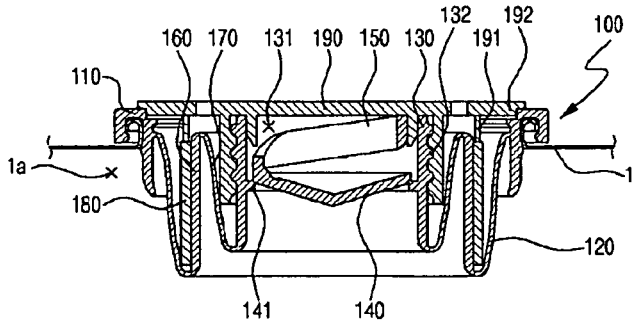

[Fig. 7]
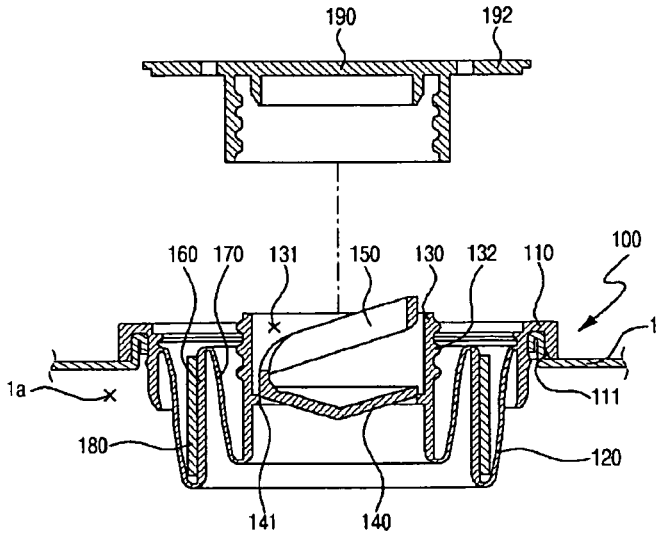

SPOUT CAP HAVING TWO STEPS TYPE STRAW PART

CROSS-REFERENCE TO RELATED APPLICATIONS

This patent application is a U.S. National Phase application under 35 U.S.C. §371 of International Application No. PCT/KR2008/003164, filed on Jun. 5, 2008, entitled SPOUT CAP HAVING TWO STEPS TYPE STRAW PART, which claims priority to Korean patent application number 20-2008-0001486, filed Jan. 31, 2008 and Korean patent application number 10-2008-0034704, filed Apr. 15, 2008.

TECHNICAL FIELD

This invention relates to a spout cap having a two steps type straw part, and more specifically to a spout cap having a two steps type straw part which is designed to retain the outermost diameter and the entire assembly height of the spout cap as the same standard of the prior art, and the straw parts by which contents in the container are flowed out are constructed as a two steps type so that contents in the container can be correctly poured into the desired place.

BACKGROUND ART

The present invention relates to a spout cap, and specifically to a spout of a can containing a liquefied article such as a lubricant or a cooking oil, constructed to be inserted into or drawn out of a container, and formed as a structure capable of sealing and releasable sealing.

The liquefied article supplied to unspecified individuals shall be filled into a container of excellent sealing for the prevention of the deterioration of contents. Also, in order to prevent any person from pouring impurities such as a poison into the liquefied article or from diluting the liquefied article for reducing the purity, it is necessary that once the container is open, it is impossible to re-seal the container.

Meanwhile, since a liquefied article such as lubricant or cooking oil is used successively in a holding/installing state by the consumer, the cap of the container is to be sealed by means of a special can plug such as a spout cap.

There are several types of can plug inserted into the pouring hole of the metal container on the market. However, although these can plugs are good for sealing, the liquefied oil such as lubricant oil is occasionally flowed out in unintended places when the oil is poured out of the metal container since the height of the can plug is low.

FIG. 1 is a cross-section showing the prior art one step type spout cap in which the straw part is in an overlapped state, and FIG. 2 is a cross-section showing the spout cap of FIG. 1 in which the straw part is in a drawn out state.

As shown in these Figs., the prior art spout cap (10), in which the straw part (12) is endowed with the function of the tap of the metal container (1), comprises: a coupling part (11) fixedly coupling with a pouring hole (1*a*) of a metal container (1); a straw part (12) extending at a predetermined length on the interior face of the coupling part (11); and a cap coupling part (13) provided at the end of the straw part (12), wherein a can plug (16) is coupled with the coupling part (13).

The coupling part (11) is coupled with the pouring outlet (1*a*) of the metal container (1), the straw part (12) is formed to be thinner as compared with the coupling part (11) so that the straw part (12) is inserted into or drawn out, on the basis of the coupling part (11) fixedly coupled with the pouring hole (1*a*) of the metal container (1).

It is preferable to form the cap coupling part (13) thicker and stronger than the straw part (12), as like the coupling part (11), so that, during the flowing out of contents in the metal container (1), contents can be prevented from draining into unintended places due to any deformation in the shape of the cap coupling part (13).

Also, a screw part (13*a*) which couples the can plug with the cap coupling part (13) is formed at the upper outer face of the cap coupling part (13), and the cap coupling part (13) is provided on the lower inner face with a tear-off film (14) connected to a weakened part (14*a*) in order to prevent an unintended outflow of contents in the metal container (1) in initial opening of the can plug.

An annular pull-tap loop (15) fixedly coupled on the upper end of the tear-off film (14) draws out and tears off the film (14) in order to easily open the film (14).

With this structure, if the user intends to outflow contents in the metal container (1) to the outside, by pulling the can plug (16) screwed into the cap coupling part (13), the flexible structured straw part (12) and the cap coupling part (13) are drawn out of the metal container (1) in the outer direction on the basis of the coupling part (11).

While the straw part (12) and the cap coupling part (13) are drawn out to the outer side, the can plug (16) is turned and divided from the cap coupling part (13), and then the pouring outlet is opened.

Thereafter, by pulling and tearing off the weakened part (14*a*) using the pull-tap loop (15) and by removing the tear-off film (14), contents in the metal container (1) can be flowed out.

After the outflow of contents in the metal container (1) is completed, the process described in the above is executed reversely so that the inflow of impurities into the metal container (1) is prevented, and contents in the metal container (1) can be protected clearly.

However, in this type of prior art spout cap (10), while the functions for preventing from contaminating and for sealing are good, there is a drawback that the engine oil may be flowed out since the length of the straw part (12) is so short not to be inserted into an engine oil hole, an oiling hole, and the like when the straw part (12) is drawn out of the can plug (16).

Furthermore, in the prior art type spout cap (10), since the metal container (1) and the spout cap (10) are standardized and produced and the length of the straw part is limited, contents in the metal container are not poured into the desired other container and place correctly, and are flowed around the other container or place. To solve this drawback, only extending the length of the straw part results in the reduction of the interior volume in the metal container, and it is limited to raise the height of the pouring outlet so that the prior automatic coupling cannot be used because the height of the assembled spout is raised.

In another prior art spout cap invented by this applicant and disclosed in South Korean Utility Model Application No. 20-1997-0040317, the length of the can plug is one step type, and the length of the extension part drawn out of the metal container is long. However, in the mass production system, although the metal container and the can plug shall be coupled together by means of the automatic production line, it is difficult to combine the can plug with the metal container, since the can plug falls down or tips over due to the higher length of the can plug, and therefore the production process must be modified.

SUMMARY

Accordingly, the object of the present invention is to provide a spout cap having a two steps type straw part which is designed to retain the outermost diameter and the entire assembly height of the spout cap as similar or identical to the prior art standard, and the straw parts by which contents in the container are flowed out are constructed as a two steps type so that contents in the container can be correctly poured into the desired place.

A spout cap having a two steps type straw part to achieve the above-mentioned object of this invention, comprising: a coupling part fixedly coupling with the pouring hole of a metal container; a first straw part extending at a predetermined length on the interior face of said coupling part; a cap coupling part having a pouring outlet through which contents in said metal container are flowed out, wherein said cap coupling part is selectively positioned in an overlapped disposition or an unfolded disposition with respect to said first straw part; an extension part arranged between said first straw part and said cap coupling part, wherein said extension part is capable of extending to an unfolded length when said cap coupling part is unfolded with respect to said first straw part; a second straw part extending from the interior face on the upper end of said extension member at a predetermined length and connected on the lower end of said cap coupling part; and can plug coupling with said cap coupling part.

As discussed in the above, a spout cap having a two steps type straw part according to the present invention is designed to retain the outermost diameter and the entire assembly height of the spout cap as similar or identical to the prior art standard, and the straw parts by which contents in the container are flowed out are constructed as a two steps type so that contents in the container can be correctly poured into the desired place.

BRIEF DESCRIPTION OF THE DRAWINGS

FIG. 1 is a cross-section showing the prior art one step type spout cap in which the straw part is in an overlapped state.

FIG. 2 is a cross-section showing the spout cap of FIG. 1 in which the straw part is in a drawn out state.

FIG. 3 is a cross-section showing the spout cap having a two steps type straw part according to one embodiment of this invention in which the two steps type straw part is in an overlapped state.

FIG. 4 is the cross-section showing the spout cap having a two steps type straw part according to an alternative embodiment of this invention in which the two steps type straw part is in an overlapped state.

FIG. 5 is a cross-section showing the two steps type straw part of FIG. 4 in a drawn out state.

FIG. 6 is the cross-section showing the spout cap having a two steps type straw part according to the another embodiment of this invention in which the two steps type straw part is in an overlapped state.

FIG. 7 is the cross-section showing the spout cap having a two steps type straw part according to the further alternative embodiment of this invention applied to the metal container in which the pouring hole is cut out to the inner side.

DETAILED DESCRIPTION

Hereinafter, the spout cap having a two steps type straw part according to one embodiment of the present invention will be described in detail, referring to the accompanying drawings.

FIG. 3 is a cross-section showing the spout cap having a two steps type straw part according to one embodiment of this invention in which the two steps type straw part is in an overlapped state, FIG. 4 is a cross-section showing the spout cap having a two steps type straw part according to an alternative embodiment of this invention in which the two steps type straw part is in an overlapped state, FIG. 5 is a cross-section showing the two steps type straw part of FIG. 4 in a drawn out state, FIG. 6 is a cross-section showing the spout cap having a two steps type straw part according to the another embodiment of this invention in which the two steps type straw part is in an overlapped state, and FIG. 7 is a cross-section showing the spout cap having a two steps type straw part according to the alternative embodiment of this invention applied to the metal container in which the pouring hole is cut out to the inner part.

As shown in FIG. 3 to FIG. 7, a spout cap having a two steps type straw part according to one embodiment of this invention consists of a coupling part (110) fixedly coupling with a pouring hole (1*a*) of a metal container (1); a first straw part (120) extending at a predetermined length on the interior face of the coupling part (110); a cap coupling part (130) having a pouring outlet (131) through which contents in said metal container (1) are flowed out, and selectively positioned in an overlapped disposition or an unfolded disposition with respect to the first straw part (120); an extension part (160, 170) arranged between the first straw part (120) and the cap coupling part (130) and being capable of extending to an unfolded length when the cap coupling part (130) is unfolded with respect to the first straw part (120); and a can plug (190) coupling with the cap coupling part (130).

The coupling part (110) is formed of the same resin material of the first straw part (120), but is thicker than the first straw part (120) so that the hardness of the coupling part (110) is higher than that of the first straw part (110), and is coupled with the pouring hole (1*a*) of the metal container (1). Meanwhile, the first straw part (120) is formed to be thinner as compared with the coupling part (110) so that the first straw part (120) is inserted into or drawn out of the spout cap (100) on the basis of the coupling part (110) fixedly coupled with the pouring hole (1*a*) of the metal container (1). The cap coupling part (130) is formed to be thicker than the first straw part (120), as the manner of the coupling part (110), in order to intensify the coupling function with the can plug (190).

Also, at the center of the upper end of the cap coupling part (130), is a perforated pouring outlet (131) through which contents in the metal container (1) flow out, and on the upper outer face of the cap coupling part (130), is formed a screw part (132) which couples the can plug (190) with the cap coupling part (130).

The cap coupling part (130) is provided on the lower inner face with a tear-off film (140) connected to a weakened part (141) in order to prevent an unintended outflow of contents in the metal container (1) in initial opening of the can plug (190).

An annular pull-tap loop (150) fixedly coupled on the upper end of the tear-off film (140) draws out and tears off the film (140) in order to easily open the film (140).

The extension part consists of an extension member (160) coupled with the end of the first straw part (120) and being capable of extending in length when the first straw part (120) is drawn out, and a second straw part (170) coupled with the extension member (160) on one end thereof and coupled with the cap coupling part (130) on the other end thereof, and the second straw part (170) can be positioned in an overlapped disposition with respect to the extension member (160).

It is preferable to form the extension member (160) having a thickness thicker than that of the first straw part (120) or the second straw part (170) in order to retain the shape of the extension member (160). The second straw part (170) having the same softness of the first straw part (120) is coupled on the end of the extension member (160) configured in the form of an annular loop.

It is preferable to form the second straw part (170) having a thickness thinner than that of the cap coupling part (130) in order to be inserted into and drawn out of the metal container (1). The diameter of the second straw part (170) is smaller than that of the first straw part (120), and the end of the second straw part (170) is coupled with the cap coupling part (130).

An annular shape-retaining member (180) is separately inserted into and coupled with the outer face of the extension member (160), so that when the first straw part (120) and the second straw part (170) is inserted into or drawn out of the spout cap (100) on the basis of the coupling part (110), the cross section of the extension member (160) is maintained and the first and second straw parts (120, 170) can be easily inserted into or drawn out the spout cap (100).

The behavior of drawing out the spout cap having a two steps type straw part according to one embodiment of this invention will be described as follows.

Firstly, pulling the can plug (190) coupled with the cap coupling part (130) in the outer direction, the second straw part and cap coupling part (170, 130) flexibly structured are drawn out of the metal container (1) in the outer direction on the basis of the coupling part (110).

Furthermore, when the can plug (190) is pulled more powerfully in the outer direction, then the flexible structured first straw part (120) is drawn out in the outer direction, and simultaneously the extension part (160) and the shape-retaining member (180) are exposed together to the outside, and thereby, the drawing function is completed.

After completing the drawing function, if the user intends to outflow contents in the metal container (1) to the outside, firstly by returning the can plug (190) screwed with the cap coupling part (130), the can plug (190) is separated from the cap coupling part (130), and then the tear-off film (140) is removed by pulling the pull-tap loop (150) and tearing off the weakened part (141).

With this processing described in the above, the pouring outlet (131) of the cap coupling part (130) is opened so that contents in the metal container (1) can be flowed out.

Because the drawing length of the spout cap (100) according to this invention is extended twice or more as compared with that of the prior art spout cap, it is easy to pour contents in the metal container (1) into the object positioned in a sensitive place.

After the outflow of contents in the metal container (1) is completed, the behavior of inserting the first and second straw parts (120, 170) into the metal container (1) on the basis of the coupling part (110) is as follows.

By screwing the can plug (190) with the cap coupling part (130) and pressing the can plug (190), the second straw part (170) is folded, and simultaneously the second straw part (170) and the cap coupling part (130) are inserted into the inner side of the extension part (160). Furthermore, by more powerfully pressing the can plug (190), the first straw part (120) is folded simultaneously with inserting the first straw part (120) and the cap coupling part (130) into the metal container (1) on the basis of the coupling part (110), and thereby the insertion function of the spout cap (100) is completed so that any inflow of impurities into the metal container (1) is prevented and contents in the metal container (1) can be maintained clearly. In addition, since the outer side of the extension member (160) is surrounded with the shape-retaining member (180), it is possible to retain the original shape of the extension member (160) when the spout cap (100) is drawn out or inserted.

While the invention is described only in terms of the embodiment constructed of a two steps type straw part, it is taken for granted that, by means of adjusting the diameter and the height of the spout cap, the straw part may be constructed of multiple steps, for example three steps or four steps, etc., so that the drawing length of the spout cap is further extended.

FIG. 6 is a cross-section showing the spout cap having a two steps type straw part according to another embodiment of the invention in which the two steps type straw part is in an overlapped state, and since general construction of this embodiment is the same as that of the spout cap having a two steps type straw part according to the other embodiment of the invention, it is abbreviated to describe in detail the construction and the functional behavior for the spout cap shown in FIG. 6.

However, in this construction of the spout cap having a two steps type straw part according to another embodiment of the invention in which the two steps type straw part is overlapped, as shown in FIG. 6, at the initial state of launching articles, the can plug (190) is not opened, and the lower section of the marginal part (192) of the can plug (190) and the upper section of the shape-retaining member (180) are connected with a weakened part (191).

Therefore, when opening the spout cap, by cutting out the weakened part (191) from the marginal part (192) of the can plug (190), and by rotating the marginal part (192) of the can plug (190) at 90 degree and oppositely folding the marginal part (192) to the outside, it is possible to use the marginal part (192) as a pull-tap, and there is no need to form and assemble the shape-retaining member (180) separately, while preventing from contaminating contents in the metal container (1).

FIG. 7 is a cross-section showing the spout cap having a two steps type straw part according to the further alternative embodiment of this invention applied to the metal container in which the pouring hole is cut out to the inner side, and since general construction of this embodiment is the same as that of the spout cap having a two steps type straw part according to one embodiment of the invention, it is abbreviated to describe in detail the construction and the functional behavior for the spout cap shown in FIG. 7.

This invention is not limited to the preferred embodiments described above, it will be understood by those skilled in the art that various changes in form and details may be made therein without departing from the spirit and scope of the invention as defined by the appended claims.

What is claimed is:

1. A spout cap having a two steps type straw part comprising:

a coupling part fixedly coupling with a pouring hole of a metal container;

a first straw part extending at a predetermined length on the interior face of said coupling part;

a cap coupling part having a pouring outlet through which contents in said metal container are flowed out, wherein said cap coupling part is selectively positioned in an overlapped disposition or an unfolded disposition with respect to said first straw part;

an extension part arranged between said first straw part and said cap coupling part, wherein said extension part is capable of extending to an unfolded length when said cap coupling part is unfolded with respect to said first straw part; and can plug coupling with said cap coupling part, wherein said extension part comprises an extension member coupled with the end of said first straw part, wherein the extension member is capable of extending in length when said first straw part is drawn out and a second straw part coupled with said extension member on one end thereof and coupled with said cap coupling part on the other end thereof, and wherein said second straw part can be positioned in an overlapped disposition with respect to said extension member.

2. The spout cap having a two steps type straw part as claimed in claim 1, wherein the depth of said cap coupling part or said extension member is thicker than that of said first straw part or said second straw part such that said cap coupling part and said extension member retain their original shapes.

3. The spout cap having a two steps type straw part as claimed in claim 1, wherein the spout cap further comprises:

an annular shape-retaining member inserted into and coupled with the outer face of said extension member so that the cross section of said extension member remains annular.

4. A spout cap having a two steps type straw part comprising:

a coupling part fixedly coupling with a pouring hole of a metal container;

a first straw part extending at a predetermined length on the interior face of said coupling part;

a cap coupling part having a pouring outlet through which contents in said metal container are flowed out, wherein said cap coupling part is selectively positioned in an overlapped disposition or an unfolded disposition with respect to said first straw part;

an extension part arranged between said first straw part and said cap coupling part, wherein said extension part is capable of extending to an unfolded length when said cap coupling part is unfolded with respect to said first straw part; and a can plug coupling with said cap coupling part;

wherein said extension part comprises, an extension member coupled with the end of said first straw part, wherein the extension member is capable of extending in length when said first straw part is drawn out, and a second straw part coupled with said extension member on one end thereof and coupled with said cap coupling part on the other end thereof, and wherein said second straw part can be positioned in an overlapped disposition with respect to said extension member, wherein said can plug is provided with an annular shape-retaining member inserted into and coupled with the outer face of said extension member so that the cross section of said extension member maintains annular, and wherein the lower section of the marginal part of said can plug and the upper section of said annular shape-retaining member are connected with a weakened part and formed with integration.

* * * * *